United States Patent [19]

Vezzani

[11] 4,103,610

[45] Aug. 1, 1978

[54] METAL SCRAP COMPACTING PRESS

[76] Inventor: Luciano Vezzani, Corso Italia, 43, Ovada, Alessandria, Italy

[21] Appl. No.: 744,213

[22] Filed: Nov. 22, 1976

[51] Int. Cl.[2] ..... B30B 7/04

[52] U.S. Cl. ..... 100/232; 75/44 S; 75/256; 100/98 R; 100/218; 100/244; 100/295

[58] Field of Search ..... 100/232, 244, 295, 98 R, 100/218, 264; 75/44 S, 256

[56] References Cited

U.S. PATENT DOCUMENTS

| | | | |
|---|---|---|---|
| 921,489 | 5/1909 | Webb | 100/232 |
| 1,284,756 | 11/1918 | O'Donnell | 100/232 |
| 1,372,898 | 3/1921 | Nelson | 100/218 |
| 1,812,797 | 6/1931 | Lindemann | 100/232 |
| 3,577,912 | 5/1971 | Busi | 100/218 |

FOREIGN PATENT DOCUMENTS

| | | | |
|---|---|---|---|
| 542,120 | 1/1932 | Fed. Rep. of Germany | 100/232 |
| 15,270 | 4/1971 | Japan | 100/295 |

*Primary Examiner*—Billy J. Wilhite
*Attorney, Agent, or Firm*—Guido Modiano; Albert Josif

[57] ABSTRACT

A press for compacting scrap metal for subsequent melting, e.g. in an electric furnace, the press comprising a supporting bed, a chamber formed in the bed and open at the top for the introduction of scraps thereinto, a closing cover for the chamber lockable in a closed portion by locking means. Movable and stationary walls define the sides of the chamber and are associated with the bed. Control and guide means for the shifting movement of the movable walls are adapted to bring the movable walls close to each other until there is defined therebetween a cavity. The distances between the walls are smaller than and proximate the distance between the inner walls of the furnace whereinto the compacted scraps are to be molten. A ram with related control means defines with its active face the base of the cavity and is movable in the bed to and away from the cover in order to press, against the cover, the scraps already compacted in the cavity. The active face of the ram has a cup-like configuration with a bottom and lateral walls surrounding the bottom and projecting towards the press cavity. In the rest position the bottom of the ram active face lies below the bottom surface of the press chamber.

3 Claims, 9 Drawing Figures

METAL SCRAP COMPACTING PRESS

BACKGROUND OF THE INVENTION

This invention relates to a press, particularly for compacting scrap metal for subsequent melting, e.g. in an electric furnace.

As is known, the feeding of metal scraps to an electric furnace for the melting of said scraps is carried out, according to a typical traditional process, by simply introducing basketfuls of scraps sequentially into the furnace. For each melting operation, three to six molten basketfuls of scraps are required one after the other. The disadvantages of this method are evident, in that the repeated opening of the furnace brings about a high rate of wasted heat as well as considerable loss of time, before the melting operation is completed. However, such feeding is made necessary by the fact that the material poured from each basket into the furnace, owing to its uncompressed state, substantially fills the whole space inside the furnace and makes it impossible to add to the feed until it has been substantially molten.

In order to obviate such drawbacks, an improved method has been proposed of feeding scraps to electric furnaces. According to this method, provision is made for the scraps to enter the furnace after they have been compacted and pressed in a cavity or recess which has substantially the same inside dimensions as the furnace. In other words, the scraps are put first into a cavity or depression formed directly in the floor or within a movable container, and then squeezed and pressed against the cavity bottom to result in a compacted layer. The cavity is next refilled with more scraps which are once again compressed to produce a further layer overlying the former. The process goes on until said cavity is filled up to a desired level. The scraps are then removed, e.g. by means of rope systems or engaging means prearranged inside the chamber, and introduced into the melting furnace.

It will be apparent how this approach, while better than the previous one, since it allows for a substantial filling of the electric furnace with a single batch or pack of scraps, is not entirely devoid of some important disadvantages. For example, the scraps put into the cavity must be selected in advance, because it is obviously impossible to fit in the cavity any elements exceeding the cavity own dimensions. Another drawback is to be found in that the numerous passes required to fill such a compression cavity with successive layers involve a considerable loss of time. Furthermore, the compacted scrap pack, resulting from superimposed layers which are substantially independent of one another, is difficult to handle and susceptible to easily separate at the layers themselves.

SUMMARY OF THE INVENTION

In view of the above situation, the Applicant is of the opinion that the need is felt for a scrap metal compacting press, or "cabbaging press", capable of eliminating the drawbacks mentioned above, thus rendering the loading of an electric furnace with scraps a more economical, simple and rational process.

It is an object of this invention to provide a scrap metal compacting press the structure whereof is such as to be useful with substantially any type of scraps, irrespective of their size.

It is another object of the invention to provide a press which can be loaded quickly and completely prior to the scrap compacting step, while requiring no preliminary handling or pre-arranging of the scraps.

It is a further object of this invention to provide a press capable of producing a compact scrap pack the shape whereof matches the cross dimension of the furnace for which it is intended, but which may have variable density within any range of selected values to fill the melting requisites.

It is still another object of the invention to provide a press capable of accomodating a random load of the scrap material to be compacted, i.e. capable of operating regularly even when the scrap load is not correctly leveled off and packed at the feed inlet to the press.

No less important an object of this invention is to provide a press having a specially simple, strong and durable structure, as well as such as to minimize the maintenance requirements thereof.

These and other objects, such as will be apparent hereinafter, are achieved by a scrap metal compacting press, according to the invention, which is characterized in that it comprises a supporting bed, a chamber formed in said bed and open at the top for the introduction of the scraps thereinto, a closing cover for said chamber, a locking means for locking said cover in a closed position, movable walls and stationary walls defining the sides of said chamber and associated with said bed, control and guide means for the shifting of said movable walls adapted to bring said walls closer to each other until they define therebetween a cavity wherein the distances between the walls are shorter than or proximate the distances between the inner walls of the furnace wherein the compacted scraps are to be molten, and a ram with related drive means defining with its active face the base of said cavity and movable in said bed to and away from said cover to compress against that same cover the scraps already compacted in said cavity.

BRIEF DESCRIPTION OF THE DRAWINGS

Further features and advantages of the invention will be more apparent from the followng description of a preferred though not exclusive embodiment of the instant press, illustrated by way of example and not of limitation in the accompanying drawings, where.

DESCRIPTION OF THE PREFERRED EMBODIMENTS

Figure 1:
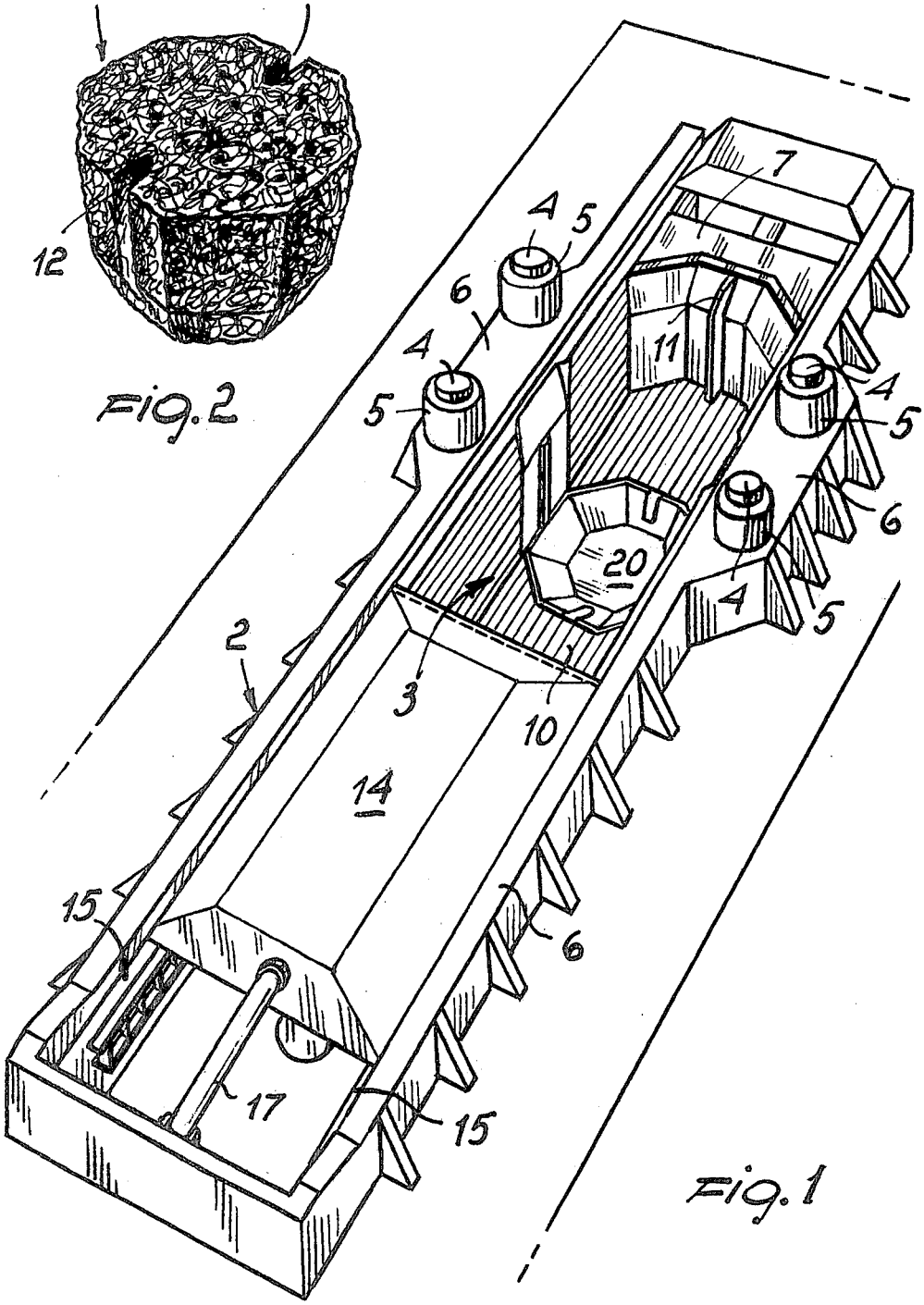
FIG. 1 is a perspective general view of the press according to the invention.
Figures 3, 4:
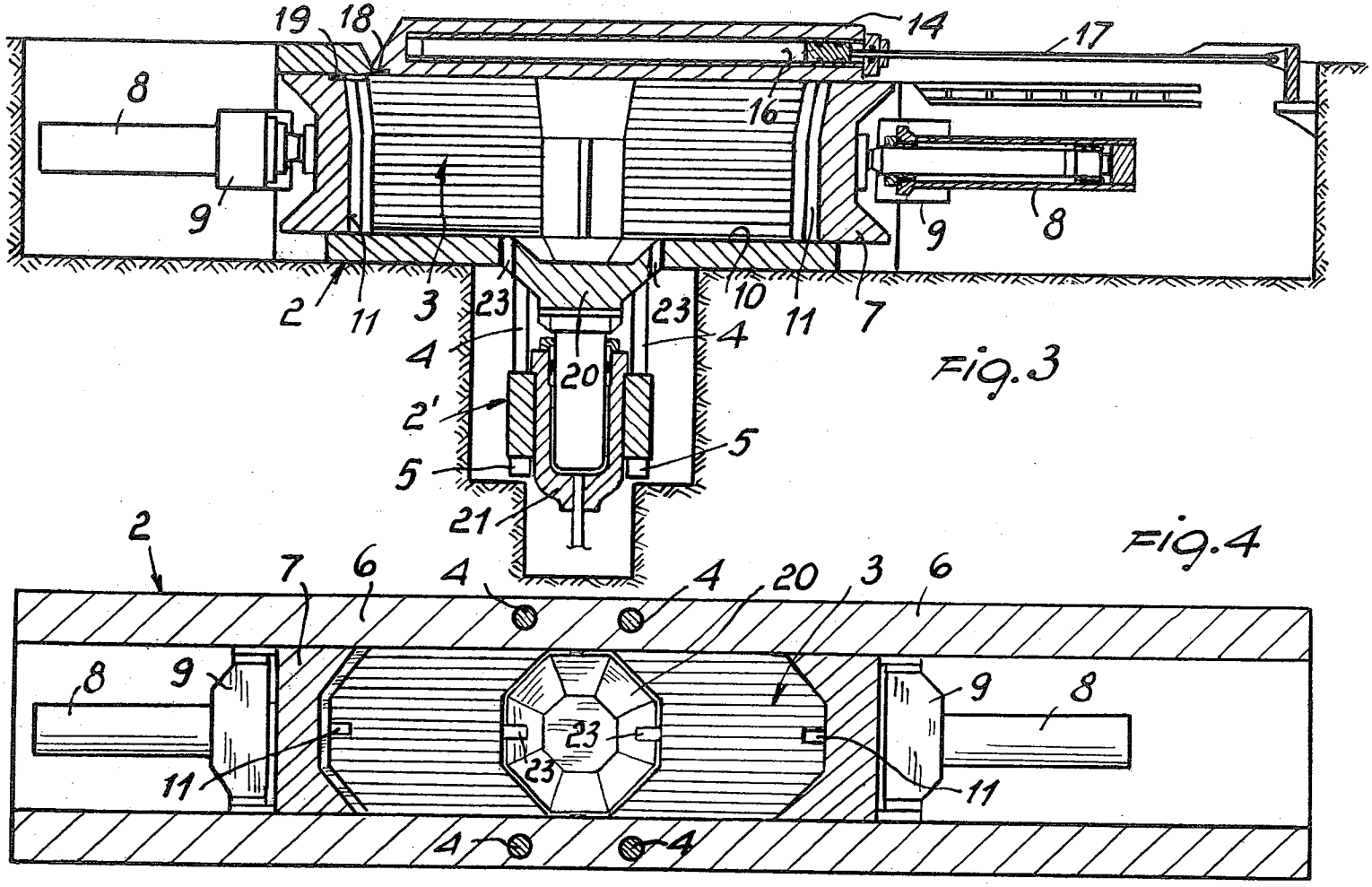
FIG. 3 is a longitudinal sectional view of the press shown in FIG. 1.
FIG. 4 is a plan view, partly sectional, of that same press.
Figure 5:
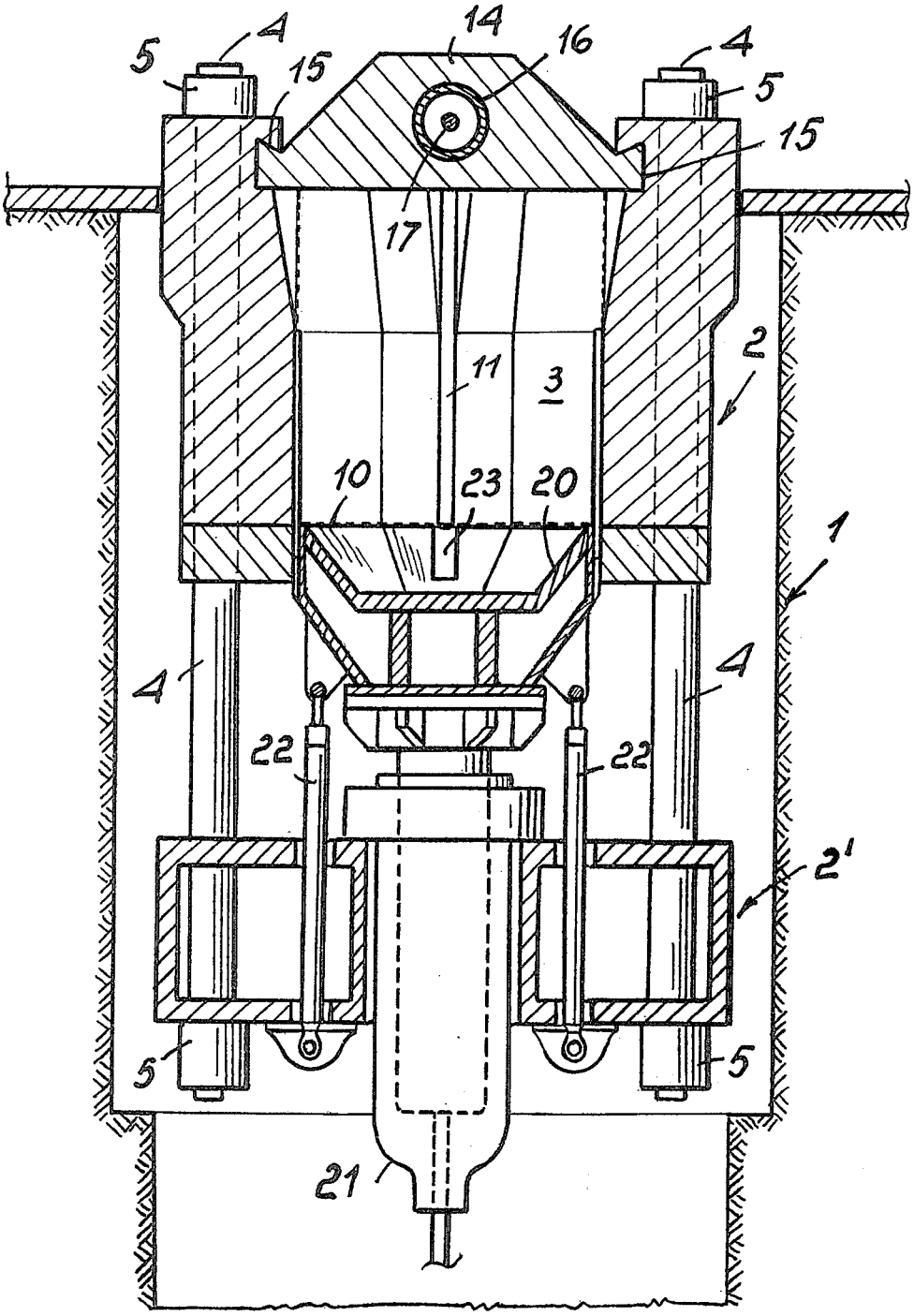
FIG. 5 shows a cross sectional view through that same press.

Making reference to the cited figures, the press according to the invention, comprises a bed 1 of large size which, as shown in detail in FIGS. 1, 3 and 5, is mostly buried in the ground. More particularly, the bed is comprised of an upper block 2 defining a chamber 3 therewithin and resting directly on the bottom of an excavation accomodating the upper block 2, and of a lower block 2' of lesser size and depending from the upper block 2 in a substantially central position. The connection of the lower block 2' to the upper block 2 is provided by columns or pillars 4 passing through the two blocks. In the embodiment shown, the pillars 4 are in the forms of stay rods having their ends threaded and in engagement with nuts 5 acting as retainers. In order to accomodate the lower block 2', a further excavation is provided in the ground centrally to the one contemplated for the upper block 2.

The chamber 3, shown more in detail in FIG. 1, defines at the top an opening wherethrough the scraps can be loaded and unloaded from the chamber. The chamber 3 is defined laterally by movable walls and stationary or fixed walls. In the embodiment shown, the chamber 3 has a cross configuration which is substantially rectangular in shape and defined by two stationary walls 6, formed directly in the upper block 2, and two movable walls 7 which are smaller than said stationary walls and slidable between such stationary walls. More particularly, the movable walls 7 have their active front surface concave such as to define substantially an octagonal portion and are movable between the stationary walls 6 to and away from each other. Control and guide means are provided for the movement of the movable walls 7, comprised of first double-acting hydraulic cylinders 8 arranged coaxially at opposite parts of the chamber 3 and acting each on one movable wall 7. The first cylinders 8 are associated with the bed 1, and more specifically with the upper block 2 of the bed 1, through bearings or supports 9 which are engaged laterally with the upper block 2 and support centrally the cylinders.

The first cylinders 8 are of a size such that the chamber 3, when the cylinders are at a position of maximum distance apart, has the distance between the stationary walls 6 considerably shorter than the distance between the movable walls 7. Provision is made for the movable walls 7, when in their positions of closest proximity, to define together with the stationary walls 6 a cavity wherein the distances between the walls are shorter than, but very close to, the distances between the electric furnace inner walls, where the scraps are to be molten. In particular, in the instant embodiment, the distance between the movable walls 7 in their positions of closest proximity is similar to the distance between the stationary walls 6. Said cavity, by virtue of the octagon portion concavity of the movable walls 7, has a cross section of substantially octagonal configuration, close to the circular cross section of the electric furnace whereto the compacted scraps are to be directed.

Figure 2:
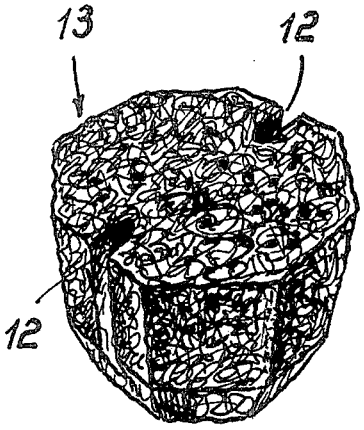
FIG. 2 shows the shape of the compacted scrap pack as obtained with the press shown in FIG. 1.

As shown in the figures, the stationary walls 6 and the bottom surface 10 of the chamber 6, excepting for the central portion which cooperates to defining said cavity, have surfaces defined by a plurality of projections or corrugations in side-by-side relationship parallel to the movable wall 7 direction of advance. The latter walls have their faces adjacent the stationary walls 6 and the bottom surface 10 contoured to match said longitudinal corrugations. Furthermore, the movable walls 7 include, at their active faces, a rib 11 which is substantially central and vertical and effective to define, as shown in FIG. 2, vertical grooves 12 in the pack 13 of compacted scraps as obtained at the end of the process. It is contemplated that the ribs 11, and accordingly the grooves 12 in the pack 13, are of a size sufficient to allow for the engagement of the pack 13 with a lifting clamp inserted with its arms within the grooves 12.

As shown best in FIGS. 1, 3 and 5, the opening defined at the top of the chamber 3 may be closed with a cover comprising, most advantageously, a shaped plate 14 having in plan view a substantially rectangular configuration and engaged laterally, along its major sides, with guides 15 provided in the upper block 2 of the bed 1. The guides 15 are linear and only allow shifting movements which are coplanar with the plate 14, preventing in particular, as shown in FIG. 5, any lifting of the plate 14. Thus, the guides 15 also constitute a means for locking the cover in its closed position.

Control means is provided for the sliding movement of the plate or cover 14 which is comprised of a second double-acting hydraulic cylinder inserted within the cover itself and provided with a stem 17 projecting from the cylinder and in engagement with the upper block 2 of the bed 1. The guides 15 and second cylinder 16 are so positioned as to impart to the plate 14 a movement parallel to that of the movable walls 7.

Figure 7:
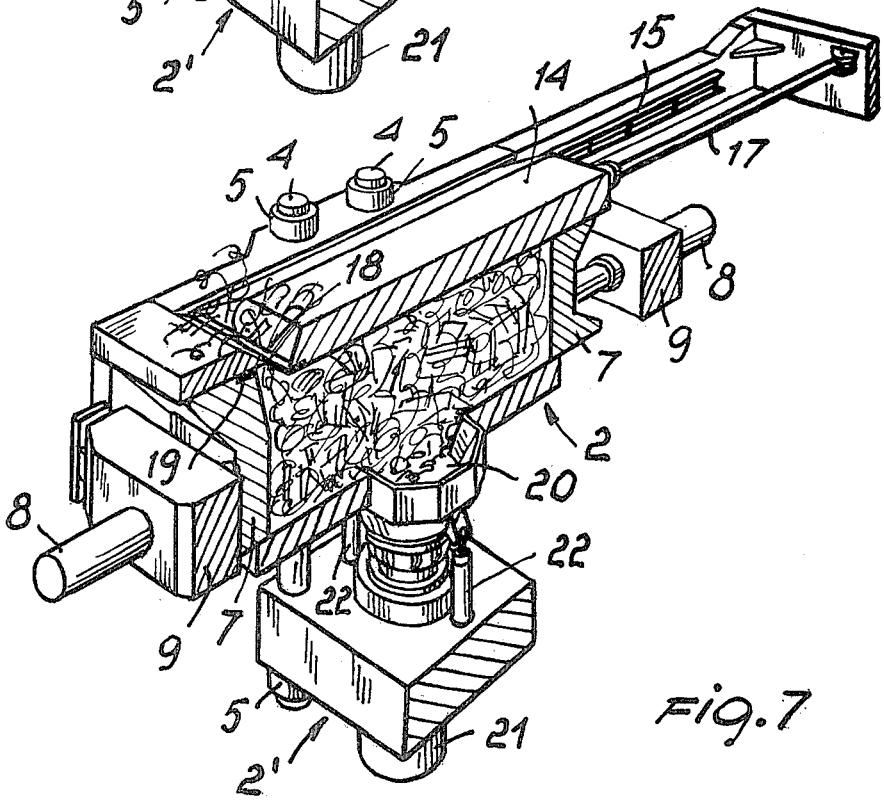
FIG. 7 is similar to FIG. 6, showing the press at its closing step prior to the actuation thereof.

Most advantageously, provision is made for the leading edge of the plate 14 in the direction of sliding closure of the plate to include a blade 18 at the bordering area with the lower face of the plate. The blade 18 is adapted to cooperate with a counterblade 19 provided at the top of the active face of the movable wall 7 which, during the compression of the scraps introduced into the chamber 3, moves in the opposite direction to the closing of the plate 14. The blade 18 and counterblade 19 cut thus the scraps therebetween which, as shown in FIG. 7, project from the cover arranged substantially at its closed position.

Centrally to the bottom surface 10, a ram 20 is provided which is movable perpendicularly to the lower face of the plate 14 and defines, with its active face, the base of said cavity formed at the center of the chamber 3 by the walls 6 and 7, in a position of maximum approach. As shown more clearly in FIGS. 3 and 5, the ram 20 has said active face of cup-like configuration with a bottom and lateral walls surrounding the bottom and projecting towards said cavity. The perimeter is advantageously of octagonal configuration and the lateral walls are inclined towards the bottom of the ram active face and towards the center of the bottom. The ram is operated by a third single-acting hydraulic cylinder. The third cylinder 21 is supported by the lower block 2' of the bed 1 and is effective to cause the ram 20 to approach the cover 14. As shown in detail in FIGS. 3 and 5, the third cylinder 21 is of large power and thus single-acting in the active direction of scrap squeezing. For returning the ram 20 to its initial position, there are provided, for example, two auxiliary cylinders 22 which engage at one end with the ram 20 and at the other end with the lower block 2'.

Those portions of the stationary walls 6 and movable walls 7, as well as the active face of the ram 20, which together with the lower face of the cover or plate 14 define the central cavity of the press in the compression position, are substantially smooth and formed with sloping sections inclined such as to widen the cavity toward the plate 14, in order to facilitate the withdrawal of the compacted scrap pack 13. There are provided, moreover, grooves 23 in the ram 20 to permit the insertion therein of the cited ribs 11.

The inventive press operates as follows.

Figure 6:
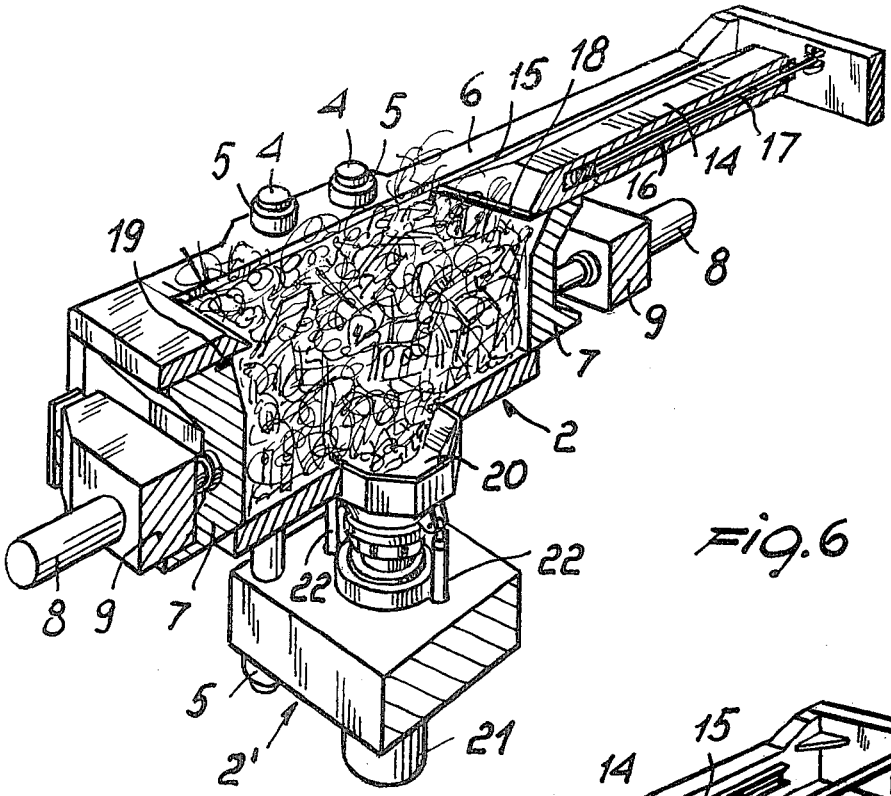
FIG. 6 is a schematic perspective sectional view of the press during the scrap loading step.
Figure 8:
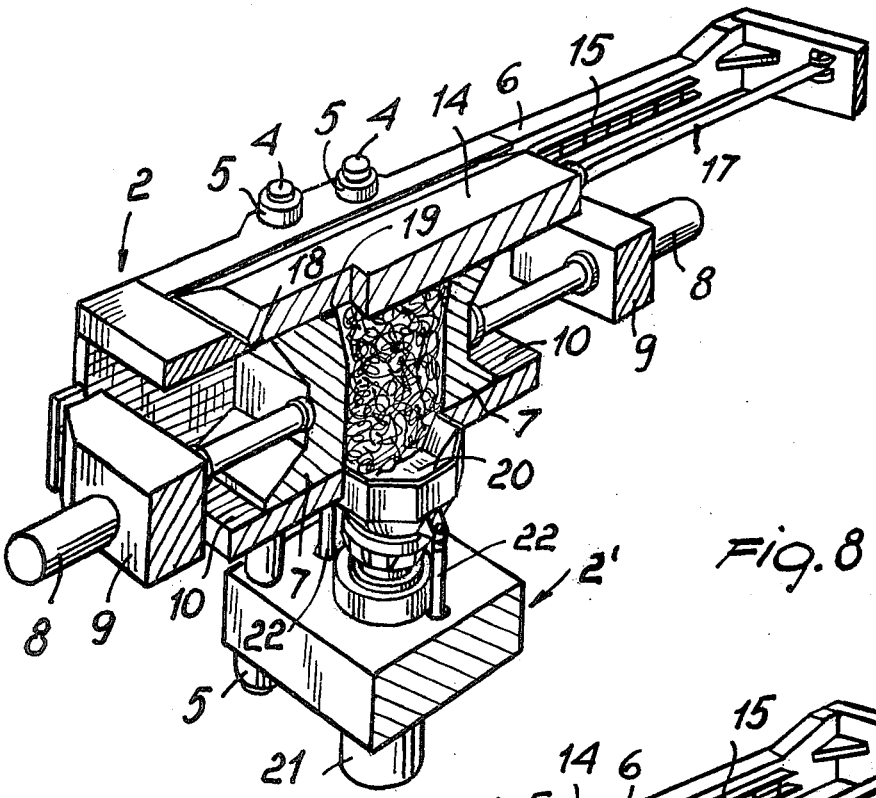
FIG. 8 is similar to the preceding figures, but showing a first compression being effected in the inventive press.
Figure 9:
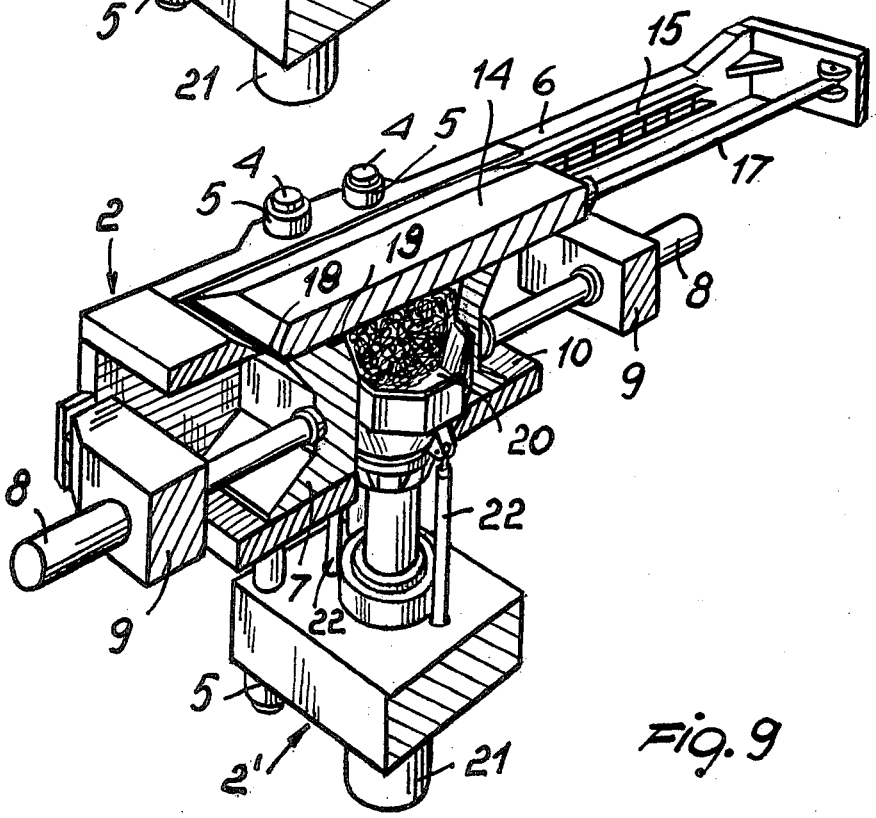
FIG. 9 shows schematically and similarly to FIGS. 6 to 8 the press according to the invention, represented at the final stage of full compaction of the scraps introduced therein.

Initially, as shown in FIG. 6, the scraps are introduced randomly and with any means into the chamber 3 at its position of maximum expansion. The cover 14 remains so positioned as to leave free a scrap inlet opening extending substantially like the bottom surface 10 of the chamber 3. After the loading of the scraps has been completed, the scraps being of any size thanks to the dimensions of the chamber 3, the cover 14 is brought forward by activating the second cylinder 16. The cover slides coplanarly to itself under the guide of the guides 15, and in its movement pushes down and squeezes the scraps projecting from the chamber 3. However, it is possible that, as shown in FIG. 7, at the cover 14 end of travel scraps build up which project from the cover. These scraps, detained by the opposing action of the cover against the edges of the chamber 3, may impede the movement of the movable walls 7, therefore said blade and counterblade are provided on the cover 14 and on one movable wall 7 in order to neatly cut, with a minimum of resistance, said projecting scraps. In fact, the followng step comprises, as shown in FIG. 8, the concurrent advance to mutual approach of the movable walls 7. The movable walls 7 move forward to establish a mutual distance apart similar to that occurring between the stationary walls 6 and define a central cavity of a size substantially similar to that of an electric furnace whereto the scraps are to be conveyed. As further shown in FIG. 8, during compression of the scraps by means of the movable walls 7 the ram 20 rests in its rest position (also shown in FIGS. 1, 3, 5, 6 and 7), in which the bottom of the ram active face lies at a level below the bottom surface 10 of the chamber 3. The movable walls 7 do not compress the scraps to a maximum but only execute what is substantially a pre-sizing of the scrap pack. By virtue of the above, irrespective of the scrap charge density in the chamber 3, the movable walls 7 are at all times enabled to reach their end of travel positions. The maximum compacting of the scraps in said cavity is performed by the ram 20 which constitutes the bottom of the cavity. As shown in FIG. 9, the ram 20, when the walls 7 reach their positions of maximum approach, moves upwards to compact the scraps to a maximum. Generally, by way of illustration, the initial volume of the scraps introduced in the chamber 3 is reduced to a final volume which is 4–5 times smaller, with a final density of of the scraps substantially of 2000 kg/m$^3$. In other words, a density is achieved which is substantially that considered ideal to obtain a good melting of the scrap pack in an electric furnace.

As shown in FIG. 2, the process results in a compact pack 13 having a size at least crosswise similar to the inner one of an electric furnace, and which is substantially homogeneous in every part. The pack 13 may thus be easily engaged with a conventional lifting clamp which will insert its jaws in the groove 12 formed in the pack by the ribs 11 projecting from the movable walls 7.

The lifting of the pack 13 from the chamber 3 of the press is facilitated not only by the grooves 12 but also by the fact that, thanks to the final compression being effected from bottom to top, the upper level of the pack 13 is substantially at floor level.

The invention fully achieves the objects proposed. Indeed, thanks to the large initial dimensions of the chamber 3, any type of scraps may be used, including the low cost ones which are oversize. The loading of the scraps into the chamber 3 may be carried out very rapidly through any load lifting means, and after the chamber 3 has been filled up, it is no longer necessary, once the compression has been completed, to add more scraps. Moreover, the final pack may have any desired density, depending on the compressive force exerted by the third hydraulic cylinder 21, while still retaining a cross size dimension which matches that of the electric furnace whereto the pack is to be conveyed. The resulting pack may also be handled and moved around without requiring special care since, owing to its being substantially homogeneous, develops no tendency to separate.

It should be stressed, lastly, that the instant press has an extremely simple and functional structure, such as to adapt itself to any applicational requirements. In fact, ribs or corrugations are provided in the walls of the chamber 3 effective to prevent any insertion of a scrap piece between the stationary walls 6 and movable walls 7 during their advance movement, while a means is provided, comprised of said blade and counterblade, capable of allowing anyhow the movable walls 7 to move forward, even when from the substantially closed cover scrap pieces happen to project outwardly.

The invention as herein described is susceptible to many modifications and variations, all within the scope of this inventive concept. Furthermore, all the detail may be replaced with technically equivalent elements.

In practicing the invention, the dimensions and materials may be any ones to suit the applications.

I claim:

1. A scrap metal compacting press, comprising a supporting bed, a chamber formed in said bed, said chamber having a bottom surface and being open at the top for the introduction of scraps thereinto, a closing cover for said chamber, means for locking said cover in its closed position, movable walls and stationary walls defining the sides of said chamber and associated with said bed, control and guide means for the shifting movement of said movable walls operative to bring the movable walls closer to each other until there is defined therebetween a cavity wherein the distances between said walls are smaller and proximate the distances between the inner walls of a furnace whereinto the compacted scraps are to be molten, a ram having an active face defining the base of said cavity, and means for moving said ram in said bed to and away from said cover in order to press, against said cover, the scraps already compacted in said cavity, wherein said active face of said ram has a cup-like configuration including a bottom and lateral walls surrounding said bottom and projecting towards said cavity, said ram being movable between a rest position in which said bottom lies at a level below said bottom surface of said chamber and a number of operative positions in which said bottom lies above said bottom surface of said chamber.

2. A scrap metal compacting press as claimed in claim 1, wherein said lateral walls are arranged to define an octagon and said movable walls each have a concave front surface defining a part of an octagon the dimensions whereof correspond to those of the octagon defined by said lateral surfaces of said ram.

3. A scrap metal compacting press as claimed in claim 2, wherein said lateral walls are inclined towards said bottom and towards the center of said bottom.

* * * * *